US006404440B1

(12) United States Patent
Doyen et al.

(10) Patent No.: US 6,404,440 B1
(45) Date of Patent: Jun. 11, 2002

(54) PROCESS AND DEVICE FOR ROTATING-CODE ADDRESSING FOR PLASMA DISPLAYS

(75) Inventors: Didier Doyen, La Bouexiére; Jean-Claude Chevet, Betton; Thierry Viellard, Acigné, all of (FR)

(73) Assignee: Thomson multimedia, Boulogne-Billancourt (FR)

( * ) Notice: Subject to any disclaimer, the term of this patent is extended or adjusted under 35 U.S.C. 154(b) by 0 days.

(21) Appl. No.: 09/061,418

(22) Filed: Apr. 16, 1998

(30) Foreign Application Priority Data

Apr. 25, 1997 (FR) ..... 97 05165

(51) Int. Cl.[7] ..... G09G 5/10
(52) U.S. Cl. ..... 345/690
(58) Field of Search ..... 345/147–180, 345/60, 63, 690–697; 348/687, 624, 797, 800, 910

(56) References Cited

U.S. PATENT DOCUMENTS 5,619,228 A * 4/1997 Doherty ..... 345/148
5,686,939 A * 11/1997 Millward et al. ..... 345/148
5,751,379 A * 5/1998 Markandey et al. ..... 348/759
5,835,072 A * 11/1998 Kanazawa ..... 345/60
6,100,939 A * 8/2000 Kougami et al. ..... 348/687

FOREIGN PATENT DOCUMENTS

EP 674 303 A2 9/1995 ..... G09G/3/28
EP 698 874 A1 2/1996 ..... G09G/3/36
FR 0 674 303 A2 * 9/1995

* cited by examiner

*Primary Examiner*—Almis R. Jankus
(74) *Attorney, Agent, or Firm*—Joseph S. Tripoli; Harvey D. Fried; Sammy S. Henig

(57) ABSTRACT

The device for addressing a plasma panel comprising a video processing circuit (7) for processing the digital video data received, a correspondence memory (8) for transcoding these data, a video memory (9) for storing the transcoded data, the video memory being linked to column driver circuits (10) for controlling the column addressing of the plasma panel, is characterized in that the transcoded data have a greater number of bits than the digital video data received and in that the processing circuit (7) comprises means for differently coding identical values of digital video data received.

Figure 3:
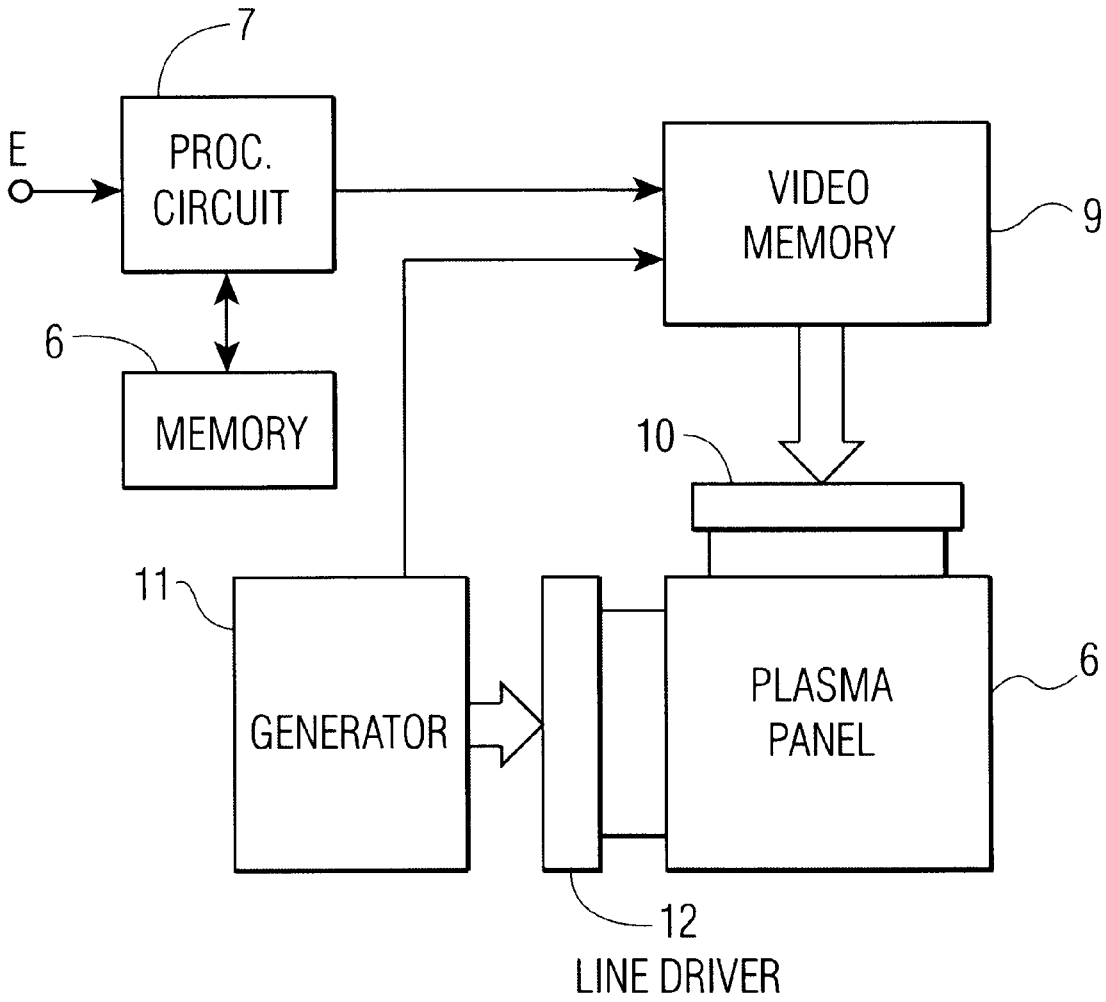

The applications target plasma panel control devices.

8 Claims, 2 Drawing Sheets

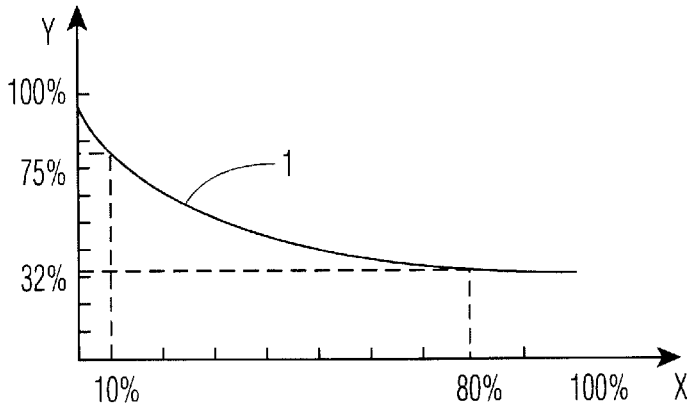
FIG. 1
FIG. 2A
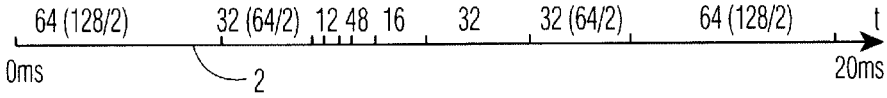
FIG. 2B
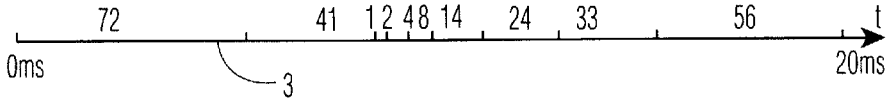
FIG. 2C
PRIOR ART
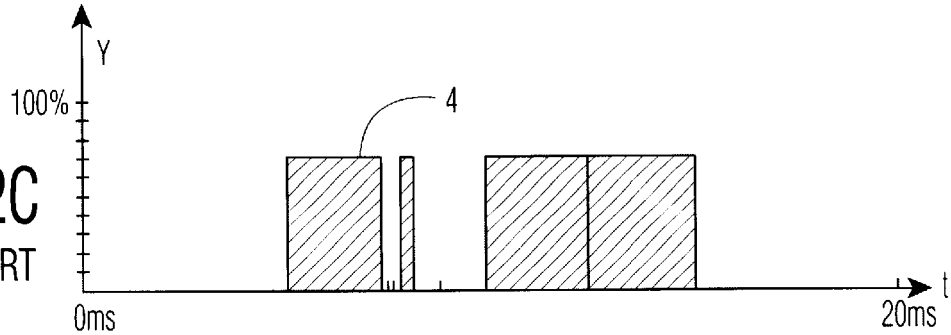
FIG. 2D
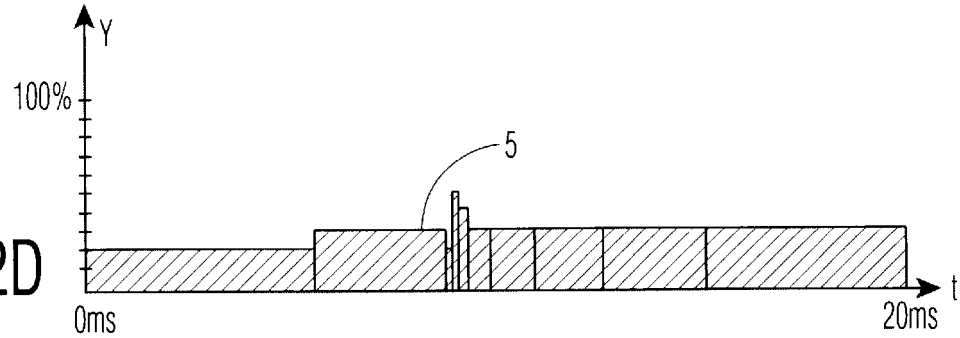

PROCESS AND DEVICE FOR ROTATING-CODE ADDRESSING FOR PLASMA DISPLAYS

The invention relates to a process and device for rotating-code addressing for plasma displays.

The technology of plasma display panels was introduced in the 1960s and culminated in monochrome displays which are highly robust vis-a-vis exterior conditions (temperature, vibrations, etc.), the applications then being essentially military. The progress in the technology made it possible to construct large-sized colour displays used in computer applications (high-resolution workstation, etc.). The end of the 1980s saw the birth of the idea of being able to display video on a plasma panel, involving a refreshing of the display at the rate of 50 images per second. This video timing constraint has still not been fully overcome at the present time, and a number of problems persist.

The term plasma panel describes the state of the gas contained in the panel. Thus, a plasma display panel consists of two glass panes separated by about a hundred microns. During manufacture, this space is filled with a gaseous mixture containing neon and xenon. When this gas is excited electrically, the electrons orbiting the nuclei are extracted and become free. The term "plasma" denotes this gas in the excited state. Electrodes are silk-screen printed on each of the two panes of the panel, line electrodes for one pane and column electrodes for the other pane. The number of line and column electrodes corresponds to the definition of the display panel. Again, during the manufacturing process, a barrier system is set in place which makes it possible physically to delimit the cells of the panel and to limit the phenomena of the diffusing of one colour into another. Each crossover of a column electrode and a line electrode will correspond to a video cell containing a volume of gas. A cell will be referred to as red, green or blue depending on the luminophore deposit with which it will be covered. Since a video pixel is made up of a triplet of cells (one red, one green and one blue), there are therefore three times as many column electrodes as pixels in a line. On the other hand, the number of line electrodes is equal to the number of lines in the panel.

Given this matrix architecture, a potential difference merely needs to be applied to the crossover of a line electrode and a column electrode in order to excite a specific cell and thus obtain, point-wise, a gas in the plasma state. The excitation of the gas is accompanied by the generation of UV which will bombard the red, green or blue luminophores and thus give a red, green or blue illuminated cell.

A line of the plasma panel is addressed as many times as are defined therein sub-scans in the grey level to be transmitted to the pixel (one speaks of grey level for each of the three components R, G, B, this level lying between 0 and 255). The pixel is selected by transmitting a voltage termed a write pulse, by way of a driver, to the whole of the line corresponding to the selected pixel while the information corresponding to the grey-related value of the selected pixel is transmitted in parallel to all the electrodes of the column in which the pixel lies. All the columns are supplied simultaneously, each of them with a value corresponding to the pixel of this column.

With each bit of the grey level information there is associated a time information which therefore corresponds to the bit illumination time or more globally to the time between two writes: a 1 value for the bit of order 4 will thus correspond to the pixel being illuminated for a duration 4 times greater than the illumination corresponding to the bit of order 1. This hold time is defined by the time separating the write cue from an erasure cue. For a grey level coded on n bits, the panel will be scanned n times in order to retranscribe this level, the duration of each of these sub-scans being proportional to the bit which it represents. By integration, the eye converts this "global" duration corresponding to the n bits into a value of illumination level. Sequential scanning of each of the bits of the binary word is therefore performed by applying a duration proportional to the weight. The addressing time of a pixel, for one bit, is the same irrespective of the weight of this bit, what changes is the illumination hold time for this bit.

All the pixels of a line are addressed simultaneously by a line driver whose load and hence the current which it must deliver depend on the number of pixels illuminated in this line. When changing from one sub-scan to the next, that is to say from one weight to another, the load, and hence the level delivered by the driver, may change, generating overbrightness effects, as explained later.

Given the present-day characteristics of panels (N1 lines) and the time required to address a line (tad), it is only possible to perform 10 sub-scans (n=10) in 20 ms. Since the video is generally coded from 0 to 255, i.e. on 8 bits, 2 extra sub-scans are therefore available. There is known, from the prior art, a transcoding of the 8-bit coding word of the video into a 10-bit coding word supplying the columns and which will be referred to here, in a general manner, as a column control word. This transcoding splits each of the two high-order bits of value 64 and 128 respectively into two sub-scans of weight 32 and two sub-scans of weight 64. Thus, the value 64 or 128 is coded by giving the value 1 to the two sub-scans of weight 32 or the value 1 to the two sub-scans of weight 64 of the column control word, thus distributing the load of the driver over the duration of the frame. However, this transcoding does not satisfactorily resolve the overbrightness effects which still remain harmful.

The object of the invention is to lessen, in a very efficient manner, the overbrightness defect.

The subject of the invention is a process for addressing cells arranged as a matrix array, each cell being situated at the intersection of a line and a column, the array having line inputs and column inputs for displaying grey levels defined by video words making up a digital video signal, the column inputs each receiving a control word for this column corresponding to the video word relating, for this column, to the,addressed line, this word being made up of n bits transmitted sequentially, each bit triggering or not triggering, depending on its state, the selection of the cell of the addressed line and of the corresponding column for a time proportional to the weight of this bit within the word, characterized in that it comprises a step effecting a transcoding of the video words into column control words such that the number of bits of the column control words is greater than that of the video words and such that different column control words are used for coding the same grey level of the video signal.

The invention also relates to a device for addressing a plasma panel for the implementation of the process, comprising a video processing circuit for processing the digital video data received, a correspondence memory for transcoding these data, a video memory for storing the transcoded data, the video memory being linked to column driver circuits in order to control the column addressing of the plasma panel, characterized in that the transcoded data have a greater number of bits than the digital video data received and in that the processing circuit comprises means for differently coding identical values of digital video data received.

By virtue of the invention, the illuminated cells are distributed more homogeneously over the timescale; the same is true for the load of the line drivers of the plasma panel which is thus better distributed so as to attenuate or even eliminate the overbrightness effects. The invention is simple and inexpensive to implement.

Other features and advantages of the invention will emerge clearly in the following description given by way of nonlimiting example and offered in conjunction with the appended figures which represent:

FIG. 1 represents the luminance level restored by the driver as a function of the percentage of cells excited in the line, FIG. 2A represents an axis graduated according to a temporal distribution of weights in powers of two corresponding to the column control words, FIG. 2B represents an axis graduated according to a temporal distribution of weights, which are not necessarily powers of two, FIG. 2C represents the temporal distribution of the load of a driver over a line, according to prior art, FIG. 2D represents the temporal distribution of the load of a driver over a line, according to an aspect of the invention FIG. 3, represents a simplified diagram of the control circuits of a plasma panel.

Globally, a cell therefore possesses only two states: excited or non-excited. Therefore, unlike with a CRT, it is not possible to carry out analogue modulation of the light level emitted. In order to account for the various grey levels and as was stated above, it is necessary to perform temporal modulation of the duration of emission of the cell within the frame period (denoted T). This frame period is divided into as many sub-periods (sub-scans) as there are bits for coding the video (number of bits denoted n). It must be possible to reconstruct all the grey levels between 0 and 255 by combination on the basis of these n sub-periods. The observer's eye will integrate these n sub-periods over a frame period and thus recreate the desired grey level.

A panel is made up of N1 lines and Nc columns supplied by N1 line drivers and Nc column drivers. The generation of grey levels by temporal modulation requires that the panel be addressed n times for each pixel of each line. The matrix aspect of the panel will enable us to address all the pixels of a line simultaneously by sending an electrical pulse of level Vccy to the line driver. The video information corresponding to the sub-scan performed at this instant is present on each of the columns and it is manifested as an electrical pulse of "binary" amplitude 0 or Vccx (indicative of the state of the coded bit). Conjugation of the two voltages Vccx and Vccy at each electrode crossover will or will not lead to excitation of the cell. This state of excitation is then sustained over a duration proportional to the weight of the sub-scan performed. Schematically, the operation can be split into two distinct actions, a first relating to the addressing of the cells and the sending of the information regarding illumination or otherwise and a second relating to the holding of this illumination, by way of a holding voltage, for the duration corresponding to the weight of the sub-scan performed. This operation will be repeated for all the lines (N1) and for all the bits addressed (n). It is therefore necessary to address n×N1 lines over the duration of the frame, thus giving the following fundamental relation:

$$T \geqq n \cdot N_1 \cdot t_{ad}$$

where $t_{ad}$ is the time required to address a line.

As seen previously, the cells of the panel are addressed as complete lines, a write pulse being sent to the line electrode by the line drivers. The video information is, for its part, sent to the column drivers. At a given instant, the line driver must therefore deliver as much extra current to sustain the excitation as there are illuminated pixels in the line. Since the supply circuits are not perfect, the current-response is not constant as a function of the load demanded.

FIG. 1 represents the shape of the grey level restored by the driver as a function of the number of excited cells and may be likened to the current response of a line driver as a function of this circuit's load. The abscissa axis x represents the number of excited cells in the line relative to the total number of cells in the line and the ordinate axis y, the value of the grey level restored by the driver relative to that restored for a driver load of nearly 0. By studying curve 1 it may be seen that for 10% of cells excited the driver responds to 75% whereas it responds to only 32% for 80% of cells excited.

The overbrightness phenomenon appears when the temporal distribution of the load is not uniform. For example, for an addressing on 8 sub-scans, if, in one frame period, the first 10 milliseconds are used to address the low-order sub-scans and the other 10 milliseconds the high-order sub-scan and if the relevant line contains 10% of cells receiving a coding level of 127 and 80% a level of 128, then the 127 level will be restored to 75 of its value and the 128 level to only 32%. Globally, the 10% of cells at the 127 level will appear brighter than the 80% of cells at the 128 level, hence the concept of overbrightness.

The video is generally quantized on 8 bits. Given the present-day characteristics of plasma panels (N1) and of the time required to address a line ($t_{ad}$), it is nowadays possible to perform up to 10 sub-scans in less than 20 ms. The basic idea of the invention consists in employing a larger number of sub-scans than that required for coding the video, for example 10 sub-scans, and in utilizing the various possibilities for retranscribing the 256 levels, that is to say the various possible sub-scan combinations for a given value to be coded. A variant of the invention consists in coding the levels of the digital video signal in a special notation rather than in the notation to the base two so as better to distribute the load over the duration of a frame. It is thus possible to choose a code whose successive weights do not follow this geometric progression with common ratio 2 and which allows several combinations for the coding of one and the same value.

An example of a code which assigns a weight other than a power of 2 to some of the bits of the binary coding word could for example consist of the following string of values:

1 2 4 8 14 24 33 41 56 72, the sum of all these weights (corresponding to place values 1 to 10 of the binary coding word) still being 255.

Thus, for this code, for example the value 100

$$\begin{aligned} 100 &= 72 + 24 + 4 \\ &= 72 + 14 + 8 + 4 + 2 \\ &= 56 + 41 + 2 + 1 \\ &= 56 + 33 + 8 + 2 + 1 \\ &= 56 + 24 + 14 + 4 + 2 \\ &= 41 + 33 + 24 + 2 \\ &= 41 + 33 + 14 + 8 + 4 \end{aligned}$$

This gives 7 different codes for the same value. Since the addressing of these 10 sub-scans is spread over the 20 ms of the frame, it will therefore be possible, depending on the code chosen, to distribute the load equitably between the various codes, and to change the code from one pixel to another of the same line for one and the same value of grey level.

Let us employ the example of the code 100 by assuming that this code is applied to 70of the cells of a line, the remaining 30% being at 0. FIG. 2 makes it possible to compare the temporal distribution of the load of a line driver of an addressing device according to the prior art with that obtained for a device applying the invention.

The abscissa axis, for curves 2, 3, 4 and 5, represents the timescale t and the graduation on this axis the temporal distribution of the codes. These graduations are therefore durations which depend on the weights allocated to the various sub-scans making up the binary word.

Curve 2 of FIG. 2A, represents an axis graduated according to a temporal distribution of the weights in powers of two, in fact represents the abscissa axis of curve 4. This axis 2 is labelled with the values to the powers of two corresponding to the weights of the column control words. Next to the values 32 and 64 there appear, in brackets, the values 64 and 128 divided by two so as to indicate that these values 64 and 128 are, as indicated earlier in the description of the nearest prior art, distributed over the two sub-scans.

Curve 3, of FIG. 2B, represents an axis graduated according to a temporal distribution of weights which are not necessarily powers of two, in fact represents the abscissa axis of curve 5. This axis 3 is labeled with the values corresponding to the weights of the example above.

Curve 4, of FIG. 2C, represents the temporal distribution of the load of a driver over a line, in the case of the prior art, the line being made up 70% by the value 100 and 30% by the value 0. The abscissa axis is the time axis and the ordinate axis represents the percentage of load of the line.

Curve 5, of FIG. 2D, represents the temporal distribution of the load of a driver over a line, when the invention is employed, the line still being made up 70% by the value 100 and 30% by the value 0. The abscissa axis is the time axis and the ordinate axis represents the percentage of load of the line.

In the case considered it is assumed that the 7 possible codes are used in an equitable manner (i.e. 10% for each of the codes).

As the response of the driver depends on the load at a given instant, the more constant the load the greater will be the attenuation of the phenomenon of overbrightness. It is clearly apparent, from curve 5, that this second code allows the load to be better distributed over the 20 ms and therefore the overbrightness phenomenon to be diminished.

FIG. 3 represents a simplified diagram of the control circuits of a plasma panel 6.

The digital video information arrives at the input E of the device which is also the input of a video processing circuit 7. This circuit is connected to a correspondence memory 8 and the input of a video memory 9 which will transmit the stored information to the input of a circuit 10 which groups together the column drivers.

A scan generator 11 transmits synchronization information to the video memory 9 and controls a circuit 12 which groups together the line drivers.

The video information coded on 8 bits and received on the input E of the device is thus processed by the processor. The latter exchanges these data with the memory or correspondence table 8 which, depending on the values of the video words sent as addresses, will deliver as data, words coded on 10 bits whose weights will have been defined beforehand. These words are then transmitted to the video memory 9 which stores them so as to deliver the successive bits of the column control words to the column drivers, in synchronization with the line scan.

The scan generator 11 carries out, for the duration of a frame and by way of the line driver circuits 12, ten sub-scans of the display, each sub-scan corresponding to one bit of the column control word. The circuit 12 delivers the addressing voltage and also the holding voltage for the duration corresponding to the weight of the sub-scan sent on the columns during this addressing.

Of course, the above description assumed a line selection of the plasma panel for a transmission of video information on the column inputs of the display, but other types of addressing could be envisaged, for example by reversing the function of the lines and columns without the process departing from the field of the invention.

The choice of the column control word for a grey level to be coded and for a given column can be made in a specified manner in such a way as to distribute the load of the line driver over the duration of a frame, although it is also possible to make this choice randomly from among all the coding possibilities.

One solution adopted consists in selecting the word which possesses the most 1 bits and, from among these words, the one whose high-order 1 bit has the smallest weight, while considering the lower high-order bits if there is equality. By virtue of this selection, the load of the driver is distributed over the maximum number of bits, thus diminishing the overbrightness effects. The choosing of the least weight makes it possible moreover to diminish the contour effects, better known as "contouring". The hardware construction is also simplified since its solution does not require the generation of a random code.

Clearly, the invention is not limited by the number of bits which quantize the digital video signal to be displayed, nor the number of sub-scans.

It may be applied equally to any type of display or device with matrix addressing which utilizes modulation of temporal type for the displaying of luminances, for example a device of the micromirror type.

Instead of emitting light directly, these micromirrors reflect received light in a point-wise manner when they are selected. The micromirrors which are therefore cells, in the broad sense of the term, arranged as a matrix array having line inputs and column inputs, are then addressed in the same way as the cells of plasma panels.

What is claimed is:

1. Process for addressing cells of a plasma panel arranged as a matrix array, each cell being situated at the intersection of a line and a column, the array having line inputs and column inputs for displaying grey levels defined by video words making up a digital video signal, the column inputs each receiving a control word for this column corresponding to the video word relating, for this column, to the addressed line, this word being made up of n bits transmitted sequentially, each bit triggering or not triggering, depending on its state, the selection of the cell of the addressed line and of the corresponding column for a time proportional to the weight of this bit within the word, characterized in that it comprises a step effecting a transcoding of the video words into column control words such that the number of bits of the column control words is greater than that of the video words and such that different column control words having different positional bit values set are used for coding the same grey level of the video signal whereby the same grey level associated with different cells can be triggered for different time periods.

2. Process according to claim 1, wherein at least one of the weights of the column control words is different from a power of two.

3. Process according to claim 1, wherein the video coding is performed on 8 bits, the column control words are 10-bit words and the various weights assigned to these column control words are computed in such a way that the mean number of combinations of said different column control words over the set of grey levels is a maximum.

4. Process according to claim 1 wherein the sum of the weights of the column control word is equal to the sum for the video word.

5. Process according to claim 1 wherein the column control words are chosen, for a given line and when several combinations of different column control words for coding the same grey level are possible, randomly from among the various possibilities.

6. Process according to claim 1 wherein the column control words chosen, when a choice is possible, are those having the most one bits.

7. Process according to claim 6 wherein the column control words chosen, when a choice is possible, are those for which the value of the highest weight is the smallest.

8. Device for addressing a plasma panel (6) for the implementation of the process according to claim 1, comprising a video processing circuit (7) for processing the digital video data received, a correspondence memory (8) for transcoding these data, a video memory (9) for storing the transcoded data, the video memory being linked to column driver circuits (10) in order to control the column addressing of the plasma panel, characterized in that the transcoded data have a greater number of bits than the digital video data received and in that the processing circuit (7) comprises means for differently coding identical values of digital video data received by providing different column control words having different positional bit values set for said identical values of said received digital video data.

* * * * *